United States Patent [19]

Parker, Jr. et al.

[11] 4,283,162

[45] Aug. 11, 1981

[54] PILING ANCHORING

[76] Inventors: Eugene R. Parker, Jr., 715 Edgewater Ave., Ocean City; Melvin B. Bryant, Old Ocean City Rd., West Ocean City, both of Md. 21842

[21] Appl. No.: 66,825

[22] Filed: Aug. 15, 1979

[51] Int. Cl.[3] ..... E02D 5/54

[52] U.S. Cl. ..... 405/244; 52/153; 52/155

[58] Field of Search ..... 405/244, 258, 232; 52/153, 154, 155, 156, 164, 165, 166

[56] References Cited

U.S. PATENT DOCUMENTS

| | | | |
|---|---|---|---|
| 574,191 | 12/1896 | Clayton | 52/165 |
| 631,168 | 8/1899 | Langston | 52/155 |
| 1,138,186 | 5/1915 | Brach | 52/166 X |
| 1,343,543 | 6/1920 | Baumgartner | 52/154 |
| 1,399,426 | 12/1921 | Harding | 52/165 |
| 1,429,964 | 9/1922 | Nordstrom . | |
| 2,187,319 | 1/1940 | Greulick . | |
| 2,716,148 | 8/1955 | Kretzer | 52/154 X |
| 2,828,515 | 4/1958 | Jenne . | |
| 2,947,149 | 8/1960 | Barkley . | |
| 4,023,314 | 5/1977 | Tanner | 405/244 X |

FOREIGN PATENT DOCUMENTS

| | | | |
|---|---|---|---|
| 95141 | 3/1958 | Norway | 52/156 |
| 174425 | 2/1961 | Sweden | 52/156 |

*Primary Examiner*—Dennis L. Taylor

*Attorney, Agent, or Firm*—Cushman, Darby & Cushman

[57] ABSTRACT

A piling assembly, and a method of anchoring the piling, are provided for increasing resistance to pull-out of the piling. The assembly includes an elongated piling having first and second ends, and first, second, third, and fourth anchors, each anchor having a circumferential extent less than one-half the circumference of the piling. The anchors are attached to the piling so that the first and second anchors are opposite each other at a first position adjacent the piling first end, and third and fourth anchors are opposite each other at a second position adjacent the piling first end. The second position is a greater distance than the sum of the distance the first position is spaced from the piling first end and the axial length of an anchor. The third and fourth anchors are circumferentially displaced from the first and second anchors around the piling. Each anchor comprises a pocket member of rigid material having an open top communicating with a hollow interior, and closed bottom, sides and ends. The pocket member, including the hollow interior, decreases in cross-sectional area from the open top to the bottom, and a plurality of flutes are formed in a side of the anchor defining the open top. Each pocket member is defined by a plate and a hollow, open-based, truncated pyramid section extending along the plate. When the piling is driven into the earth, if an obstruction is encountered the piling is rotated until the anchor encountering the obstruction is no longer in line with the obstruction, and then driving is continued.

21 Claims, 8 Drawing Figures

Fig. 1
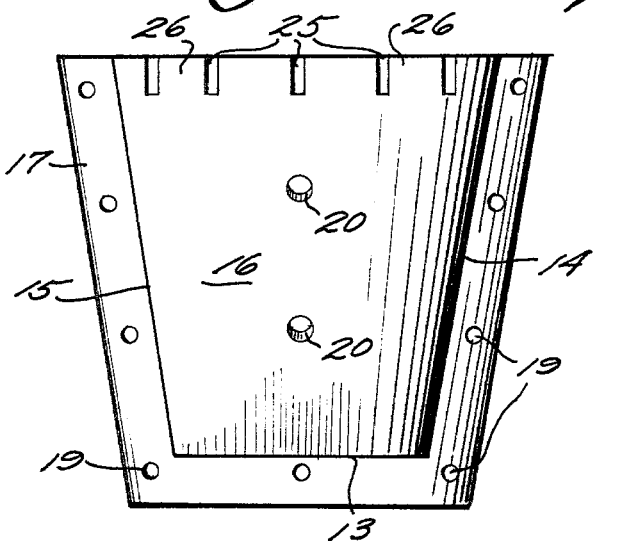
Fig. 3
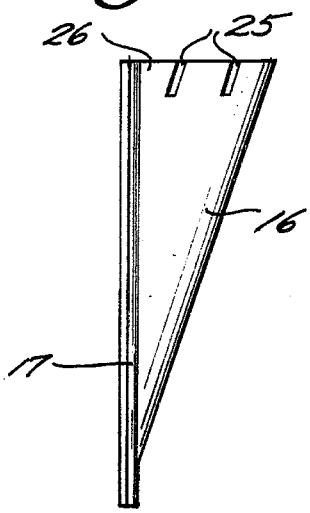
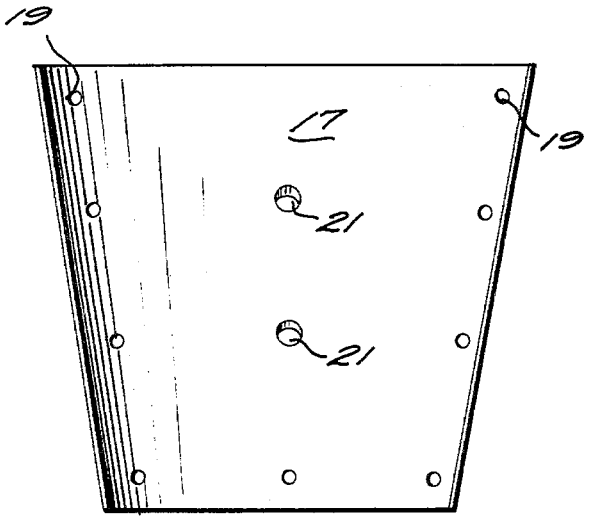
Fig. 2
Fig. 4
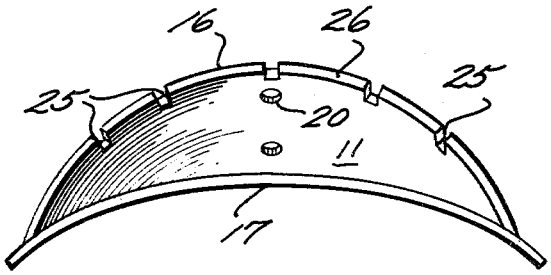
Fig. 7
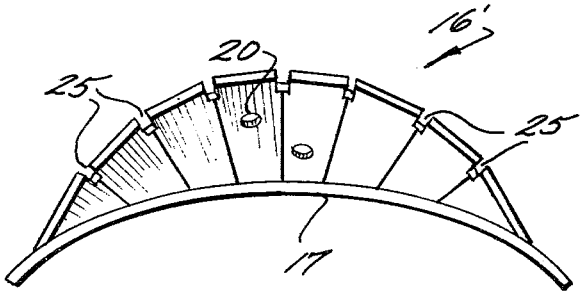

Fig. 5
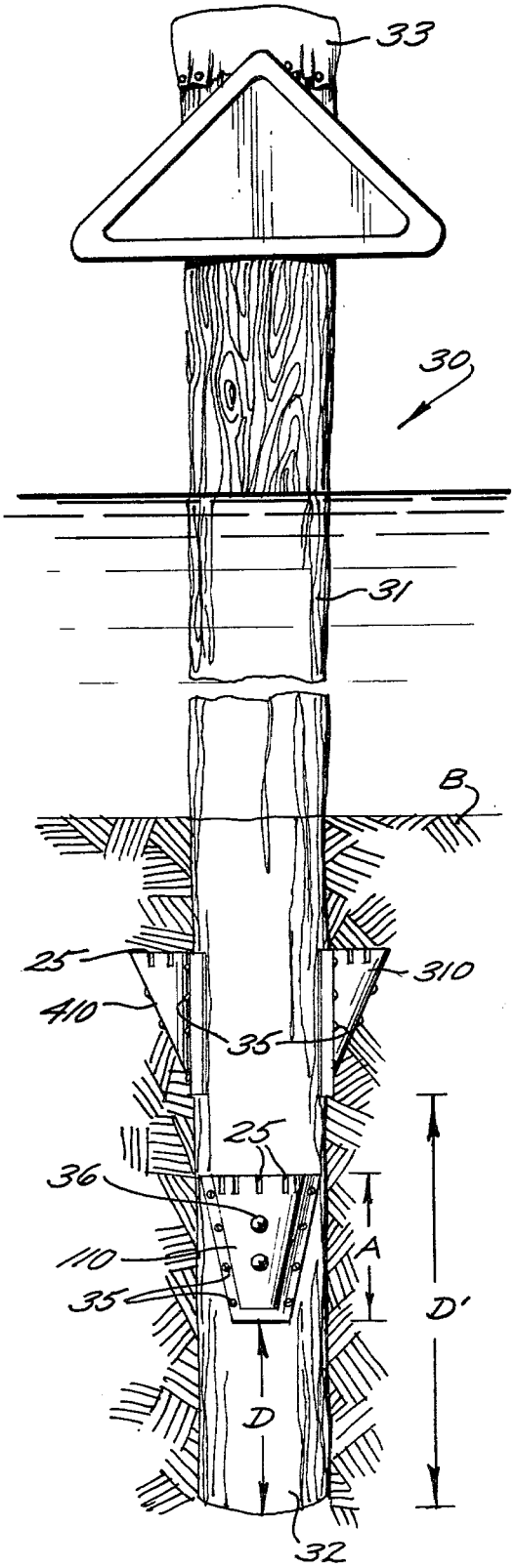
Fig. 6a
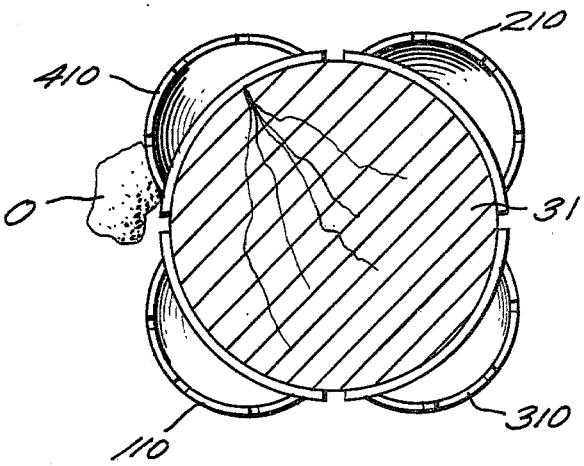
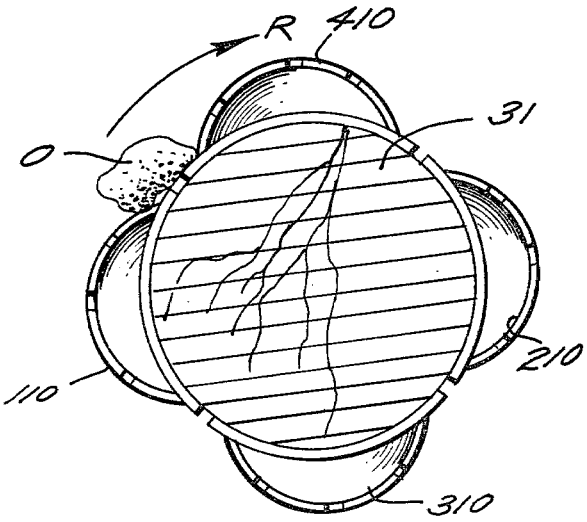
Fig. 6b

PILING ANCHORING

BACKGROUND AND SUMMARY OF THE INVENTION

The invention relates to piling assemblies and to a method of utilization of the piling assemblies to anchor them in the earth.

Especially where heavy ice, wind, and tidal loads are applied to pilings utilized in pier, dock, and marker constructions, conventional tapered pilings do not have a large enough resistance to pull-out pressure, and thus can become loose or un-seated. This is particularly so where the conditions of the bottom into which the piling is driven are especially soft or loose. This can be overcome to a certain extent by driving pilings large and first, however, this increases the resistance during driving and requires that the smaller end of the piling be able to withstand the abuse it will encounter during driving without cracking or splitting. Also, since the thin end of the piling is then above the bottom and water level, it has much less resistance to normal working loads than if the large end of the piling were above bottom and water level. Other attempts have also been made to overcome the problems of piling loosening by providing anchors of a variety of configurations on the pilings, such as shown in U.S. Pat. Nos. 1,429,964 and 2,187,319. Oftentimes, however, prior art anchor constructions unduly increase the resistance to driving of the pilings, and can have a tendency to become hung-up on obstructions, preventing complete penetration of the piling to the desired depth.

According to the present invention, a piling assembly is provided that has substantially increased pull-out resistance compared to conventional pilings, yet has negligibly increased resistance to being driven into almost any bottom texture or terrain, and will not easily become hung-up on obstructions in the bottom surface. Additonally, the assembly according to the present invention has markedly increased extraordinary pull-out pressure resistance so that the probability of being dislodged when water level increases at times when there is surface ice, and other extraordinary conditions, are encountered, is reduced.

The piling assembly according to the present invention comprises an elongated piling having first and second ends, and first, second, third and fourth anchors, each anchor having a circumferential extent less than one-half the circumference of the piling, and extending radially outwardly from the piling, and having a given axial extent. The anchors are attached to the piling so that the first and second anchors are disposed opposite each other at a first position adjacent, but spaced from, the piling first end, and the third and fourth anchors are disposed opposite each other at a second position adjacent, but spaced from, the piling first end a greater distance than the sum of the distance the first position is spaced from the piling first end and the axial length of an anchor. The third and fourth anchors are circumferentially displaced from the first and second anchors around the piling. Preferably, each anchor has a circumferential extent about one-quarter the circumference of the piling, and the third and fourth anchors are circumferentially displaced about 90° from the first and second anchors around the piling.

In the method according to the present invention of driving the piling into the earth, the piling is driven with the small end first, to a desired depth or until an obstruction is encountered by one of the anchors. If an obstruction is encountered the piling is rotated until the anchor encountering the obstruction is no longer in line with the obstruction, and then driving is continued again until the desired piling depth is reached or until another obstruction is encountered, at which time the rotating and further driving steps are repeated.

Each anchor according to the present invention comprises a pocket member of rigid material having an open top communicating with a hollow interior, and a closed bottom, sides, and ends. The pocket member, including the hollow interior thereof, decreases in cross-sectional area from the open top to the bottom thereof, and means are provided for attaching the pocket member to the piling so that the bottom of the anchor is closest to the piling first end. A plurality of flutes are formed in a portion of the anchor defining the open top, the flutes extending from the open top toward the bottom, and these flutes greatly increase extraordinary pull-out pressure resistance by allowing the open top of the pocket to deform as a result of attempted pull-out, thereby increasing resistance further. Once the piling has had about 24–36 hours to set in place, the anchors become filled with material in the bottom into which the piling is driven, and provide enormous resistance to normal pull-out pressures.

Each of the pocket members is defined by a plate and a hollow, open-based, truncated pyramid section extending along the plate. The plate overlaps the truncated pyramid section on the sides and bottom thereof, and a plurality of openings for receiving fasteners are formed in the portions of the plate overlapping the truncated pyramid section, the fasteners attaching the pocket member to the anchor. Openings for receiving fasteners extending through the pyramid section and the plate also may be provided. Preferably the plate is curved, having concave and convex faces with the concave face having a contour corresponding to the circumference of a piling to which it is connected, to the truncated pyramid section being disposed on the convex face of the plate. Most desirably, the pyramid section is a section of the truncated right circular cone. The pocket member may be constructed by welding together two separate pieces of material (i.e. the plate and the pyramid section), or by a press in a single stamping operation.

It is the primary object of the present invention to provide an improved piling anchor, piling assembly, and method of utilization of the piling assembly, having markedly increased resistance to both normal and extraordinary pull-out pressure, but having negligibly increased resistance to driving. This and other objects of the invention will become clear from an inspection of the detailed description of the invention and from the appended claims.

BRIEF DESCRIPTION OF THE DRAWINGS

FIGS. 1–4 are top, bottom, side, and end views respectively of an exemplary anchor according to the present invention;

FIG. 5 is a side schematic view illustrating a piling assembly according to the present invention in place, anchored in a bottom of a body of water;

FIGS. 6*a* and 6*b* are top, cross-sectional, schematic views illustrating a sequence of operation in driving of the piling assembly of FIG. 5 into place in the water body bottom; and FIG. 7 is an end view of a modified configuration of the anchor of FIG. 4.

DETAILED DESCRIPTION OF THE DRAWINGS

An exemplary anchor for a piling or the like, according to the present invention, is illustrated generally at 10 in the drawings. The anchor is in the form of a pocket member of rigid material (e.g. steel), having an open top 11 (see FIG. 4 in particular) and closed bottom 12, ends 14 and 15, and sides 16 and 17. The open top communcates with the hollow interior, and the pocket member, including the hollow interior thereof, decreases in cross-sectional area from the open top 11 to the bottom 13 thereof. The pocket member preferably is defined by a plate, forming the side 17, and a hollow, open-based, truncated pyramid section, defining the side 16, extending along the plate 17. The plate overlaps the truncated pyramid section 16 on the sides and bottom thereof (see FIG. 1 in particular), and a plurality of openings 19 are formed in the overlapping portions of the plate 17, which openings 19 are adapted to receive fasteners and provide means for attaching the pocket member to a piling or the like. Additionally, openings 20, 21, may be formed in the pyramid section 16 and plate 17, respectively, for receiving a fastener for further effecting fastening of the anchor to a piling or the like. The pyramid section 16 may be formed by a plurality of polygon sections, as indicated at 16' in FIG. 7, or may comprise a section of a truncated right circular cone (a right circular cone being considered a special case of a pyramid for the purposes of the present application), which configuration is preferred. The plate 17 preferably is curved having concave and convex faces, with the concave face having a contour corresponding to the circumference of the piling or the like to which the plate 17 will be connected, and the truncated pyramid section 16 being disposed on the convex face of the plate 17, as illustrated in the drawings. Additionally, a plurality of flutes 25 are formed in the section 16, extending from the open top 11 toward the bottom 13 thereof. The flutes 25 are dimensioned and spaced so that they comprise means for providing deformation of the portion of the section 16 defining the open to 11 (i.e. thetabs 26) should withdrawal of a piling or the like to which the anchor 10 is attached be attempted. This deformation action markedly increases the extraordinary pull-out pressure resistance of the anchor 10 in the piling assembly that it forms a part of.

The anchor 10 may be formed by welding together separate plates 17 and pyramid sections 16 pieces, or by a press in a single stamping operation.

A piling assembly according to the present invention is illustrated generally at 30 in FIG. 5 and FIGS. 6*a* and 6*b*. The piling assembly 30 comprises an elongated piling 31 having first and second ends 32, 33 respectively, the first end 32 preferably having a smaller cross-sectional area than the second end 33. First, second, third, and fourth anchors are provided, illustrated at 110, 210, 310, and 410 respectively in the drawings. Each anchor has a circumferential extent less than one-half the circumference of piling 31, extending radially outward from the piling and having a given axial extent, and preferably each anchor has a circumferential extent of slightly less than one-quarter the circumference of the piling 31.

As illustrating in the drawings, the anchors 110, 210, 310, 410 are attached to the piling 31 so that the first and second anchors 110, 210 are disposed opposite each other at a first position adjacent, but spaced from (a distance D) the piling first end 32. The third and fourth anchors 310, 410 are diposed opposite each other at a second position adjacent, but spaced from, the piling first end 32, a distance D' from the first end 32. The distance D' is greater than the sum of the distance D and the axial length A of an anchor. The third and fourth anchors 310, 410 are circumferentially displaced from the first and second anchors 110, 210 around the piling, preferably circumferentially displaced about 90°. The distance D may be chosen so that it is about one foot, and the distance D' may be chosen so that it is about two feet, with the dimension A of about six inches. Fasteners 35, 36 extend through the openings 19 and 20, 21 of each of the anchors for fastening the anchors to the piling 31.

Exemplary piling anchors and a piling assembly according to the present invention having being described, an exemplary method of utilization thereof will now be set forth.

A pile 31 is prepared for driving by locating at a first portion a distance D from the smaller cross-sectional area end 32 of the piling 31 first and second anchors 110, 210, with the open tops 11 of the pocket members comprising the anchors 110, 210 further from the first end 32 than the closed bottoms 13 thereof. The anchors 110, 210 are nailed and lagged in place opposite one another around the piling 31. At the second position a distance D' from the piling first end 32, the third and fourth anchors 310, 410 are similarly nailed and lagged in placed opposite each other, and circumferentially displaced from the first and second anchors 110, 120.

After the piling 31 has been prepared for driving, the first end 32 thereof is then placed into the ground (e.g. the bottom B of the body of water) and the second end 33 of the piling 31 is impacted to drive the piling into the bottom B. The anchors 110, 210, 310, 410 only negligibly increase resistance to this driving due to the location thereof and their generally tapered construction.

During driving, should an obstruction O (see FIGS. 6*a* and 6*b*) be encountered by one of the anchors (anchor 410 in FIG. 6*a*), hang-up of the piling 31 is avoided by rotating the piling 31 (see arrow R in FIG. 6*b*) until the anchor encountering the obstruction (410) is no longer in line with the obstruction O. Then driving is continued until the desired piling depth is reached, or until another obstruction is encountered by one of the anchors, at which time the rotating and further drivings steps are repeated.

Once the piling 31 has been driven to its desired depth, it is allowed to settle for about 24–36 hours, during which time the hollow interiors of the anchors completely fill with bottom material, and the bottom material completely forms around the first end 32 of te piling and the anchors 10, and excellent resistance to normal pull-out pressure is provided. In situations where extraordinary pull-out pressure will be applied to the piling 31, the tabs 26 of the anchors 10 will be deformed outwardly to compensate for the stress resulting from the pull-out pressure, thus providing even greater resistance to pull-out.

It will thus be seen that according to the present invention a piling anchor, piling assembly, and method of utilization thereof, have been provided which greatly increase pull-out resistance of the piling while only negligibly increasing resistance of the piling to driving. Thus, by practicing the invention it is possible to greatly reduce the times between piling maintenance and replacement, and/or allow the utilization of shorter pilings than are conventional, with concommitant savings in costs, energy, and resources.

While the invention has been herein shown and described in what is presently conceived to be the most practical and preferred embodiments thereof, it will be apparent to those of ordinary skill in the art that many modifications may be made thereof within the scope of the invention, which scope is to be accorded the broadest interpretation of the appended claims so as to encompass all equivalent devices, methods, and assemblies.

What is claimed is:

1. A piling assembly comprising an elongated piling having first and second ends;

first, second, third, and fourth anchors, each anchor having a circumferential extent less than one-half the circumference of said piling, and extending radially outwardly from the piling, and having a given axial extent;

said anchors being attached to said piling so that said first and second anchors are disposed opposite each other at a first position adjacent, but spaced from, said piling first end, and said third and fourth anchors being disposed opposite each other at a second position adjacent, but spaced from, said piling first end a greater distance than the sum of the distance said first position is spaced from said piling first end and the axial length of an anchor; and said third and fourth anchors being circumferentially displaced from said first and second anchors around said piling; and each of said anchors comprising a pocket member of rigid material defined by a plate and a hollow, open-based, truncated pyramid section extending along said plate with the height of said pyramid section generally coincident with the axial extent of said anchor.

2. An assembly as recited in claim 1 wherein each anchor has a circumferential extent of about one-quarter the circumference of said piling, and wherein said third and fourth anchors are circumferentially displaced about 90° from said first and second anchors around said piling.

3. An assembly as recited in claim 2 wherein said piling first end has a smaller cross-sectional area than said piling second end.

4. An assembly as recited in claim 3 wherein each of said anchors is tapered from a first end thereof to a second end thereof along its axial extent, increasing in radial extent from said first end to said second end, and is hollow; and wherein each anchor is mounted on said piling so that said first end thereof is closer to said piling first end than said second end thereof.

5. An assembly as recited in claim 1 wherein said pyramid section is a section of a truncated right circular cone.

6. An assembly as recited in claim 5 wherein said cone section is approximately one-third of a truncated right circular cone.

7. An assembly as recited in claims 1 or 6 wherein said plate is curved, having concave and convex faces with the concave face having a contour corresponding to the circumference of said piling, and wherein said pyramid section is disposed on the convex face of said plate.

8. An assembly as recited in claim 1 further comprising means associated with each of said anchors to allow deformation of a portion thereof to increase resistance to pull-out should pull-out of the piling be attempted.

9. An assembly as recited in claim 1 further comprising a plurality of flutes formed along said pyramid section open-base, which allow deformation of the base of the pyramid section.

10. An assembly as recited in claim 1 further comprising means defining a plurality of openings in said plate at portions thereof exterior of said pyramid section for allowing passage of fasteners therethrough to fasten said plate to said piling.

11. An assembly as recited in claims 1 or 10 further comprising means defining at least one opening in said plate in-line with an opening in said pyramid section walls.

12. An assembly as recited in claim 1 wherein said pocket member hollow interior decreases in cross-sectional area from the open top to the bottom thereof.

13. An anchor for piling or the like comprising a pocket member of rigid material, having an open top communicating with a hollow interior, and closed bottom, sides, and ends;

said pocket member, including the hollow interior thereof, decreasing in cross-sectional area from the open top to the bottom thereof; and means for attaching said pocket member to a piling or the like wherein each of said pocket members is defined by a plate and a hollow, open-based, truncated pyramid section extending along said plate and wherein said plate overlaps said truncated pyramid section on the sides and bottom thereof, and wherein said means for attaching said pocket member to a piling or the like comprises a plurality of openings for receiving fasteners formed in the portions of said plate overlapping said truncated pyramid section.

14. An anchor as recited in claim 1 wherein said plate is curved, having concave and convex faces with the concave face having a contour corresponding to the circumference of a piling or the like to which it is adapted to be connected, and wherein said truncated pyramid section is disposed on the convex face of said plate.

15. An anchor as recited in claim 14 wherein said pyramid section is a section of a truncated right circular cone.

16. A method of driving a circular cross-section piling into the earth in a water body bottom, utilizing first, second, third, and fourth anchors, each anchor having a circumferential extent less than one-half the circumference of said piling, and extending radially outwardly from the piling, and having a given axial extent; and the piling having first and second ends; said method comprising the steps of (a) disposing said anchors on said piling so that the first and second anchors are disposed opposite each other at a first position adjacent, but spaced from, the piling first end, and the third and fourth anchors are disposed opposite each other at a second position adjacent, but spaced from, the piling first end a greater distance than the sum of the distance the first position is spaced from the piling first end and the axial length of an anchor; and so that the third and fourth anchors are circumferentially displaced from the first and second anchors around the piling;

(b) driving the first end of the piling into the ground until an obstruction is encountered by one of the anchors;

(c) when an obstruction is encountered, rotating the piling until the anchor encountering the obstruction is no longer in line with the obstruction; and then (d) containing driving until the desired piling depth is reached; or until another obstruction is encountered by one of the anchors, and then repeating steps (c) and (d).

17. A method as recited in claim 16 comprising the further step of forming surface manifestations of the anchors that will cause deformation of portions of the anchors should pull-out be attempted.

18. A method as recited in claim 16 comprising the further step of forming the piling first end so that it has a smaller cross-sectional area than the piling second end, and having a gradual taper from the first end to the second end thereof.

19. A piling assembly comprising an elongated piling having first and second ends;

first, second, third, and fourth anchors, each anchor having a circumferential extent less than one-half the circumference of said piling, and extending radially outwardly from the piling, and having a given axial extent;

said anchors being attached to said piling so that said first and second anchors are disposed opposite each other at a first position adjacent, but spaced from, said piling first end, and said third and fourth anchors being disposed opposite each other at a second position adjacent, but spaced from, said piling first end a greater distance than the sum of the distance said first position is spaced from said piling first end and the axial length of an anchor; and said third and fourth anchors being circumferentially displaced from said first and second anchors around said piling; and each of said anchors comprising a pocket member of rigid material, having an open top communicating with a hollow interior, and closed bottom sides, and ends.

20. An assembly as recited in claim 1 wherein said piling is circular in cross-section.

21. An assembly as recited in claims 1 or 20 wherein said piling is electricly non-conductive.

* * * * *